United States Patent [19]

Odham

[11] 4,248,064

[45] Feb. 3, 1981

[54] LOCK-STITCH KNITTED ELASTIC FABRIC

[75] Inventor: Carl J. Odham, Asheboro, N.C.

[73] Assignee: Stedman Corporation, Asheboro, N.C.

[21] Appl. No.: 12,024

[22] Filed: Feb. 14, 1979

[51] Int. Cl.[3] ..... D04B 23/08

[52] U.S. Cl. ..... 66/192; 66/190

[58] Field of Search ..... 66/190, 192, 193, 195, 66/196, 202, 9

[56] References Cited

U.S. PATENT DOCUMENTS

| | | | |
|---|---|---|---|
| 3,258,941 | 7/1966 | Formenti | 66/193 |
| 3,314,251 | 4/1967 | Bunger | 66/193 |
| 3,570,482 | 3/1971 | Emoto et al. | 66/193 |
| 3,673,820 | 7/1972 | Sarmiento | 66/193 |
| 3,965,703 | 6/1976 | Barnhardt | 66/193 |
| 4,003,224 | 1/1977 | Odham | 66/193 |

*Primary Examiner*—Ronald Feldbaum
*Attorney, Agent, or Firm*—Pennie & Edmonds

[57] ABSTRACT

An elastic warp knit fabric having ravel resistant features made of a number of base yarns which are knitted to form a plurality of closed loops extending in a warp direction to form wales including interior wales, an end wale and an adjacent wale adjacent to the end wale. Elastic yarns are laid into the adjacent wale and interior wales. Filler yarns are included which extend in a weft direction and which are laid into the closed loops of each course. A locking yarn to prevent unraveling of the end wale is knitted into the end wale to form open loops in alternate courses and knitted into the adjacent wale to form closed loops in alternate courses.

The end wale may have the elastic yarn eliminated therefrom in order to form a soft edge of the fabric in which event the adjacent wale then has a further elastic yarn to compensate for the elastic yarn removed from the end wale. A further filler yarn is included in the closed loops of the end wale and the adjacent wale and a still further filler yarn included in the closed loops of the interior wales and the adjacent wale in order that the fabric may be balanced. In addition a further locking yarn may be knitted into the adjacent wale to form open loops in alternate courses and in a further adjacent wale to form closed loops in alternate courses to provide an additional protection against unraveling of the yarns comprising the end wale and adjacent wales.

11 Claims, 6 Drawing Figures

LOCK-STITCH KNITTED ELASTIC FABRIC

TECHNICAL FIELD

The invention relates to an elastic knit fabric having a locking yarn knitted into the edge of the fabric to prevent unraveling. A further feature of the invention provides for an elastic fabric which has a soft edge and which is of a balanced construction so as to lie flat when in an untensioned state.

BACKGROUND ART

Warp knit elastic fabrics are often used as belting for undergarments where the belting of fabric is sewn along a lower edge to the undergarment and where the upper edge is free to contact the skin of the wearer. Many forms of such fabrics in the past have been subjected to unraveling particularly when one end of a belt or strip of fabric joins with another end of the fabric by means of a butt-type joint. If through a production error, a portion of the upper edge of the fabric extends above the butt joint, this portion through use may have a tendency to unravel.

A locking yarn has been used in the past to overcome any tendency of the upper edge to unravel whereby the locking yarn was knitted into each course of two wales adjacent a lateral top edge of the fabric to form an open loop in alternate wales. A further prior art construction of a warp knit elastic fabric utilizing a ravel resistant locking yarn is disclosed in my U.S. Pat. No. 4,003,224 dated Jan. 18, 1977 where a locking yarn is knitted into an end or locking wale to form open loops in alternate courses and where the yarn is laid in a weft direction over a number of wales in the remaining courses. However, both of these uses of a locking yarn has been restricted to a warp knit fabric having a square edge construction in which the weft or filler yarns overlie each other and extend over and beyond the lateral end wale of the fabric. Such uses of a locking yarn are not applicable to warp knit fabrics having a crisscross edge construction wherein the weft or filler yarns extend in opposite directions to alternate with one another in the direction of fabric thickness.

It is therefore an object of my invention to provide for an elastic warp knit construction having a high degree of resistance to unraveling where the fabric may comprise either a square edge of crisscross edge construction.

A further problem existing with prior art elastic warp knit fabrics used for belting for undergarments and the like is that the edge of the fabric contacting the skin of the wearer tends to pinch the skin when the fabric contracts after being stretched thus giving a feeling of a rough edge. It is a further object of my invention to provide for a warp knit elastic fabric construction having an edge which will not pinch the skin of a wearer and which will have a soft edge and where the construction will still provide a fabric having dimensional stability when in a relaxed or untensioned state.

GENERAL DESCRIPTION OF THE INVENTION

Broadly my invention comprises constructing an elastic warp knit fabric such that it has a plurality of base yarns knitted in successive courses to form a plurality of successive closed loops extending in a warp direction where the loops constitute a plurality of wales including an end wale, a first adjacent wale adjacent to the end wale, a second adjacent wale adjacent the first adjacent wale and a plurality of interior wales. A first elastic yarn is laid in the interior wales and in the first and second adjacent wales. A first filler yarn extends in a weft direction in each course and is contained within the closed loops of the interior wales, first and second adjacent wales and the end wale. A second filler yarn extends in a weft direction and is contained within those closed loops of the end wale and the first adjacent wale. A first locking yarn is knitted to form an open loop in alternate courses of the end wale and to form a closed loop in alternate courses of the first adjacent wale. The locking yarn serves to prevent unraveling of the base yarns making up the adjacent and end wale. The end wale will also have an elastic yarn laid therein in those fabric constructions where it is not necessary to have a soft edge.

In one form of the invention the first and second filler yarns extend in the same direction to overlie each other to form a square edge construction, and in another form of the invention, the first and second filler yarns may extend in opposite directions to alternate with one another in the direction of fabric thickness to form a crisscross construction.

Where it is desired that the fabric have a soft edge, the elastic yarn is left out of the end wale, and to compensate for the loss of elastic yarn in that wale, the first wale adjacent to the end wale has two elastic yarns laid therein or, in the alternative, one elastic yarn having a tensile strength equal to two of the replaced elastic yarns. Preferably a third filler yarn extends in a weft direction over the interior wales and first and second adjacent wales and a fourth filler yarn extends over the interior wales and the second adjacent wale. The third filler yarn balances the area of the fabric over which the second filler yarn does not extend while the fourth filler yarn likewise provides building up or bulk to the fabric to balance the thickness of the fabric over the two adjacent wales with that over the interior wales.

An additional second locking yarn is provided with the second locking yarn being knitted so as to form open loops in alternate courses of the first adjacent wale and closed loops in alternate courses of the second adjacent wale. This second locking yarn along with the first locking yarn prevents unraveling of the yarns making up the end wale and adjacent wales.

BEST MODES FOR CARRYING OUT THE INVENTION

Figure 1:
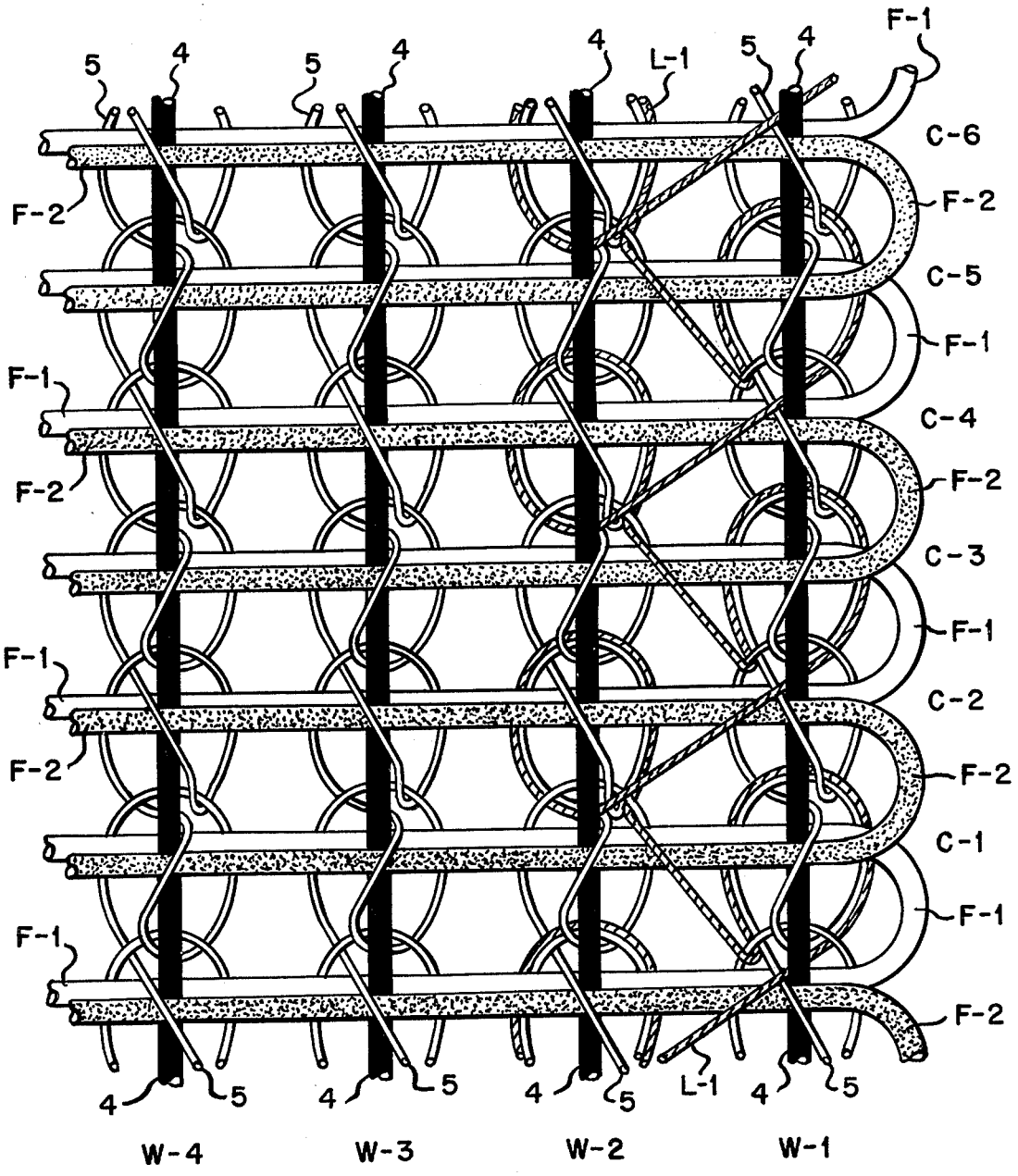
FIG. 1 is a schematic sketch illustrating an elastic warp knit fabric constructed according to the invention having a crisscross edge and a locking yarn for preventing unraveling.

Referring to FIG. 1 there is illustrated an elastic warp knit fabric constructed according to the invention having a base yarn 5 which is knitted in successive courses C-1–C-6 to form a plurality of successive closed loops extending in a warp direction where the successive loops form wales W-1–W-4. Each wale has an elastic yarn 4 laid in where the yarn 4 comprises an elastomer to provide stretch features in the longitudinal direction.

The wales W-1–W-4 are joined by filler yarns F-1 and F-2 each of which extends in a weft direction and wherein each yarn is contained within the closed loops formed by the base yarn 5. As shown in FIG. 1, the filler yarns in a single course extend in opposite directions and overlie each other such that at the right lateral side, the filler yarns overlie the lateral end of wale W-1 such that they alternate with one another in the direction of the fabric thickness. Such a construction is referred to as having a crisscross edge where, as shown, the rounded end portion of the yarn F-1 is positioned behind the elastic yarn 4 and alternates with the rounded end portion of yarn F-2 positioned in front of the yarn 4.

A locking yarn L-1 is knitted into the lateral end wale W-1 to form a plurality of open loops in courses 1, 3 and 5 and a plurality of closed loops in courses 2, 4 and 6 of adjacent wale W-2 which is adjacent to the lateral end wale W-1. This locking yarn serves to prevent any unraveling of the elastic fabric.

Preferably the locking yarn L-1 comprises a stretch yarn of a non-stabilized polyester material which is not set while filler yarns F-1 and F-2 and base yarn 5 comprise fully set or stabilized polyester yarns.

Figure 2:
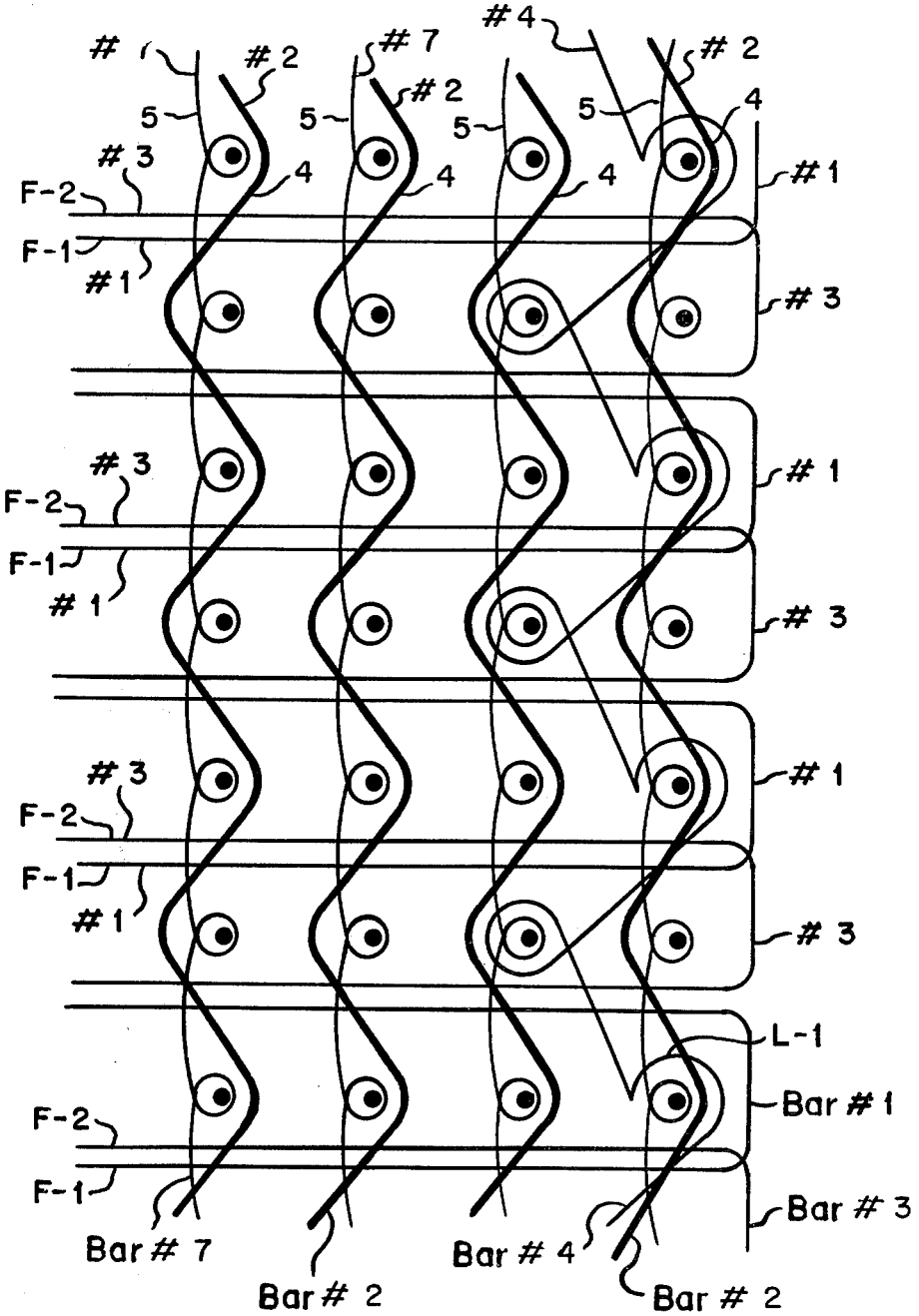
FIG. 2 is a stitch construction diagram of the fabric of FIG. 1 illustrating guide bar movement of the knitting machine used in producing the fabric.

Referring to FIG. 2 the lapping movements of the various guide bars controlling the yarns for producing the fabric of FIG. 1 are shown where bar 1 on the back or creel side of the knitting machine controls the placement of filler yarn F-1. Bar 2, the next bar moving from the back of the machine to the front, controls the lay-in of the elastomer yarn 4, bar 3 controls the placement of the filler yarn F-2, bar 4 of the knitting of the locking yarn L-1 and bar 7 the knitting of the base yarn 5.

Figure 3:
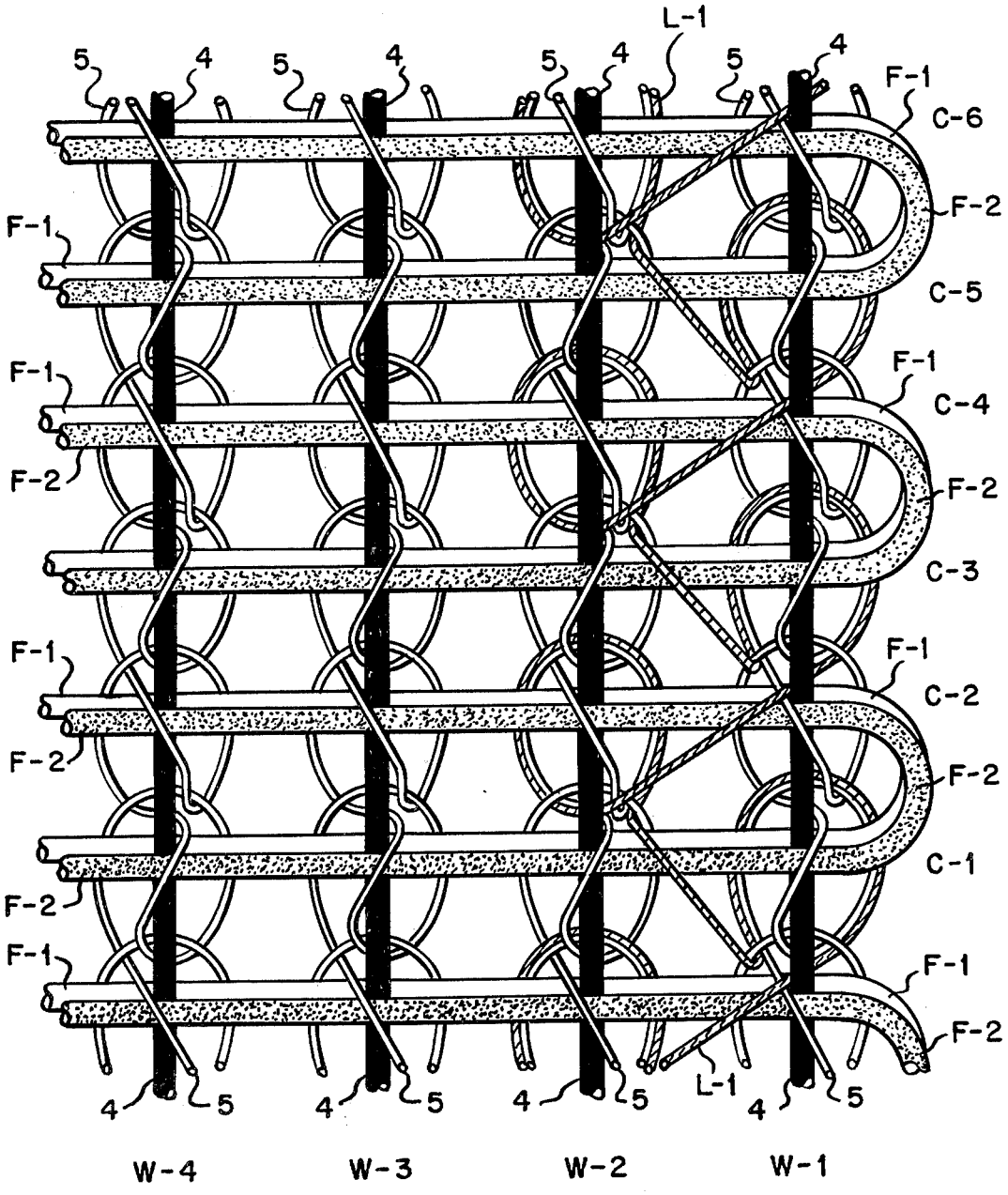
FIG. 3 is an elastic warp knit fabric constructed according to the invention having a square edge and a locking yarn.
Figure 4:
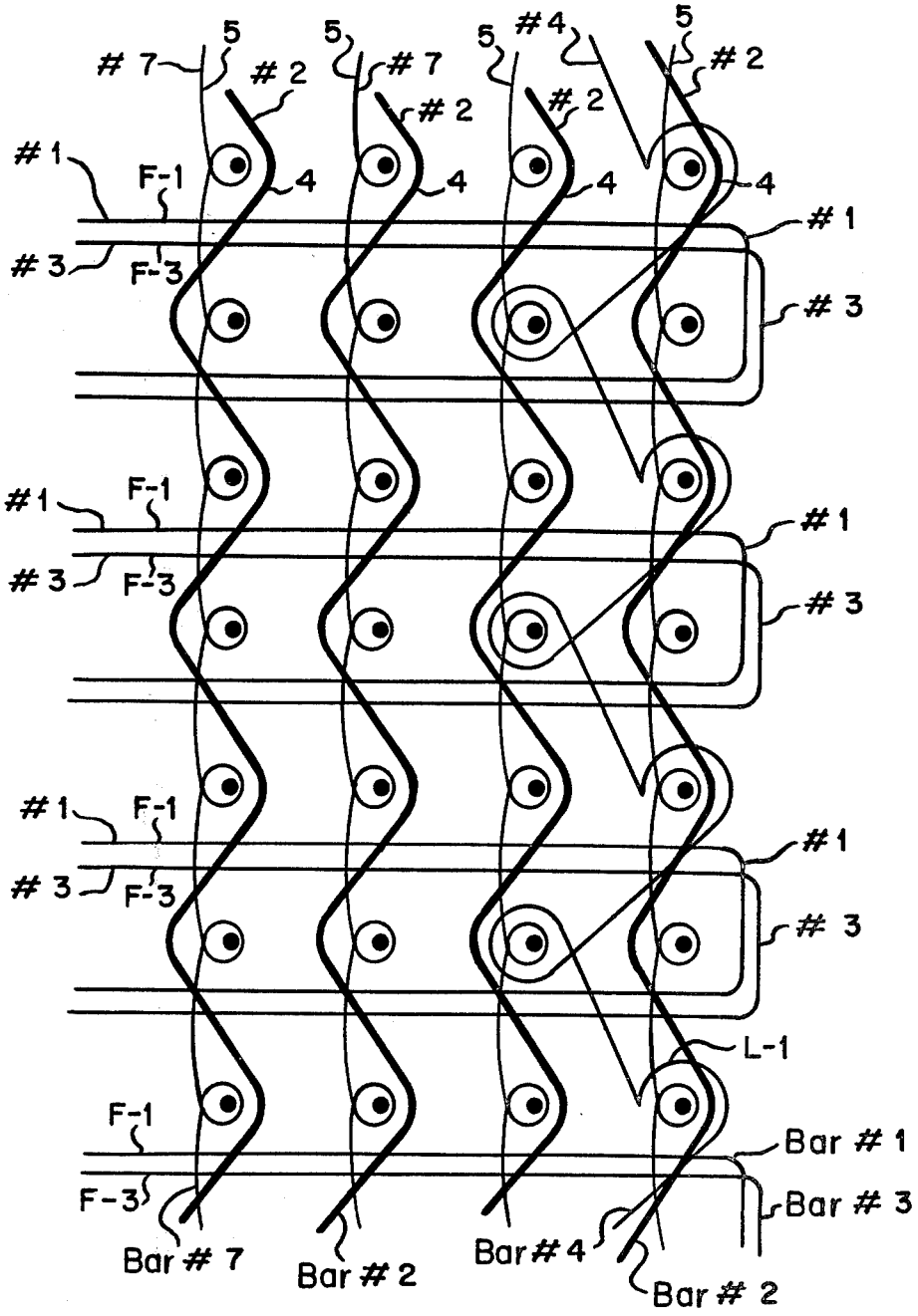
FIG. 4 is a stitch construction diagram of the fabric of FIG. 3 illustrating guide bar movement.

Referring to FIG. 3 a fabric generally similar to that shown in FIG. 1 is illustrated except that the fabric has a square end construction. As shown the filler yarns F-1 and F-2 overlie each other and extend in the same direction in the individual courses. The rounded end portions of the filler yarns F-1 and F-2 extend beyond the lateral end wale W-1 and overlie each other. The fabric of FIG. 3 in all other respects, and including the composition of the various yarns, may be the same as that as the fabric in FIG. 1, and the lapping movement of the bars controlling the various yarns, as illustrated in FIG. 4, are the same except for those of the filler yarns.

Figure 5:
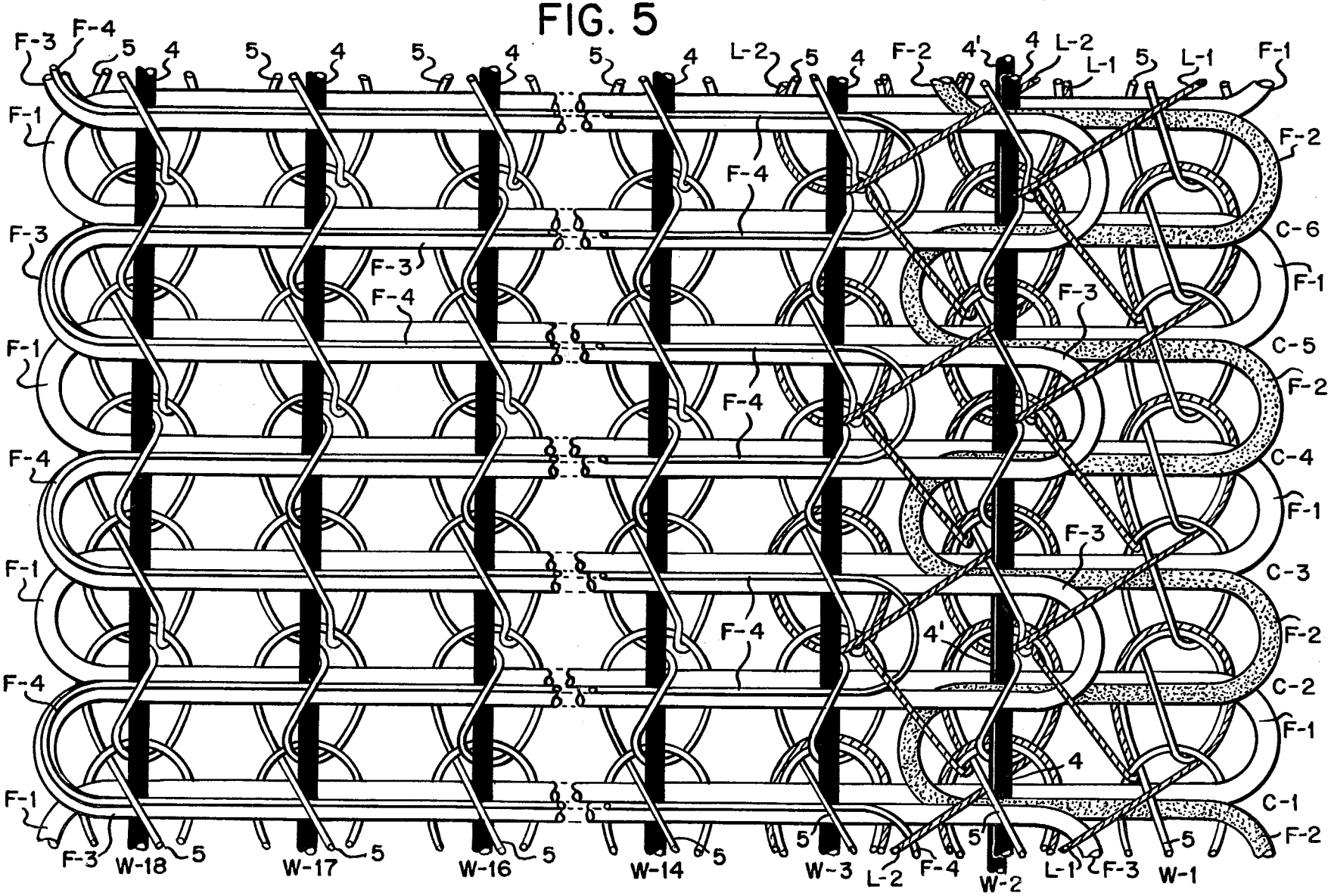
FIG. 5 is an elastic warp knit fabric constructed according to the invention having a soft edge and locking yarns.

Referring to FIG. 5, there is illustrated a warp knit fabric having a soft edge and which includes a locking yarn stitch construction of the type utilized with the fabrics of FIGS. 1 and 3. The fabric shown comprises an elastic belting which is eighteen wales wide. Like the fabric of FIGS. 1 and 3, the soft edge fabric contains a plurality of base yarns 5 which are knitted in successive courses to form the wales W-2–W-18 and a base yarn 5′ which is knitted in successive courses to form a lateral end wale W-1. Wale W-2 is considered as a first adjacent wale, wale W-3 as a second adjacent wale, wales W-1–W-17 as interior wales and wale W-18 as a further end wale.

In order to provide a soft edge feature and to prevent binding or pinching of the belting on the skin of a wearer, the lateral end wale W-1 corresponding to the top of belting that might be applied to undergarments, does not have an elastomer yarn 4 laid therein. It then becomes necessary to provide for an increased pull or tension in the first adjacent wale W-2 to make up for the lack of the elastomer yarn in wale W-1 to maintain the course gauge across the width of the fabric. This is done by laying in a second elastomer 4′ within the wale W-2. It is to be understood that instead of laying in two elastomers 4 into wale W-2, that in the alternative a single elastomer yarn having a pull or tension equivalent to two of the yarns 4 could be substituted.

In order to increase the softness of the top edge, a filler yarn F-2′ comprising a stretch non-stabilized polyester yarn to give a fluffy effect extends over the end wale W-1 and the first adjacent wale W-2. This requires that a third filler yarn F-3 be extended over the second adjacent wale W-3 as well as wales W-3–W-18 so as to maintain balance over the width of the fabric. A further filler yarn F-4 extends in a weft direction over wales W-3–W-18 and provides balance in thickness of the fabric over wales W-3–W-18 to compensate for the two filler yarns F-2 and F-1 extending over wales W-2.

It is important that the fabric be balanced so that strips or belting made of the fabric will lie flat in the untensioned state in order that it may be easily sewn to undergarments.

In addition to the locking yarn L-1 as included in the fabrics of FIGS. 1 and 3, the fabric of FIG. 5 requires an additional locking yarn L-2 in order to prevent unraveling of the yarns comprising the end wale and wales W-2 and W-3. As shown the locking yarn L-2 is knitted so as to form an open loop in the first course of wale W-2, the same as does locking yarn L-1 form a closed loop in the first course of wale W-1 and then locking yarn L-2 is knitted to form a closed loop in the second adjacent wale W-3 after which, and in the same manner as locking yarn L-1, it is returned to the adjacent wale on the right wherein an open loop is knitted. The result is that open loops are knitted in alternate courses of wale W-2 and closed loops in alternate courses of wale W-3.

The composition of the various yarns making up the fabric of FIG. 5 is similar to that of the fabrics of FIGS. 1 and 3 except that base yarn 5′ knitted into the closed loops of wale W-1 is a stretch yarn with the remaining of the yarns 5 being, like in the fabrics of FIGS. 1 and 3, set or stabilized yarns and except, as explained above, filler yarn F-2 is a stretch yarn. Filler yarns F-1, F-3 and F-4 are set yarns.

Figure 6:
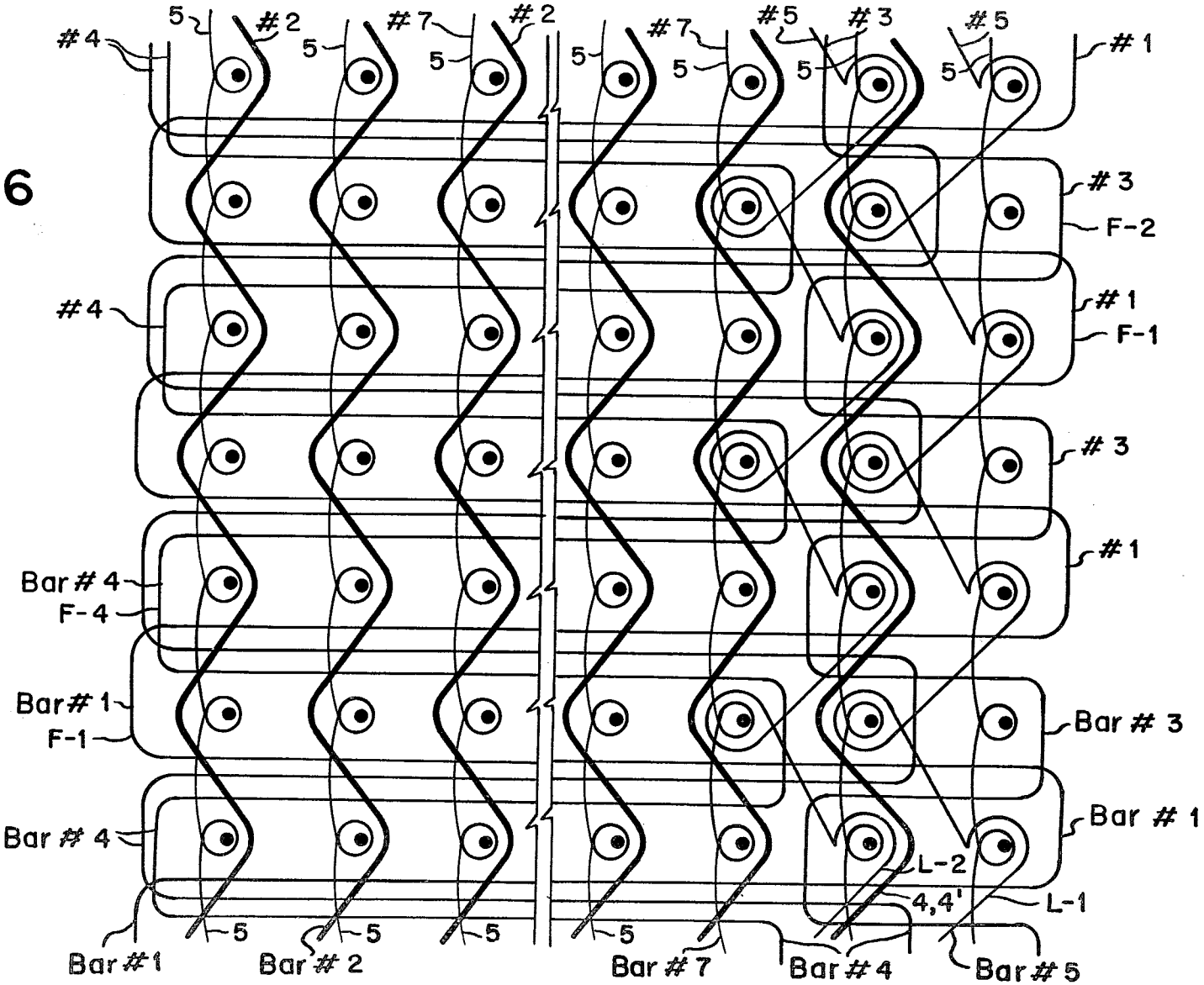
FIG. 6 is a stitch diagram of the fabric of FIG. 5 illustrating the guide bar movement used in producing the fabric.

Referring to FIG. 6 which illustrates the lapping movements of the bars controlling the yarns, the movement of the bars is generally similar to that shown in FIGS. 2 and 4 with the exception that bar 4 controls the movement of the two yarns, namely filler yarns F-3 and F-4, bar 5 controls the movement of the two locking yarns L-1 and L-2 and bar 2 controls the inlay of two elastomeric yarns 4 and 4′ in wale W-2 and where two such yarns are utilized instead of a single larger yarn, the bars are modified to carry two yarns by including two yarn guides on each bar.

Preferably the needle arrangement of the machine for producing the fabric according to the invention is such that the needles knitting the locking yarns L-1 and L-2 are latch-type needles while the remainder of the needles of the machine are spring or beard-type needles.

I claim:

1. An elastic warp knit fabric comprising a plurality of base yarns knitted in successive courses to form a plurality of successive closed loops extending in the warp direction which in turn form a plurality of wales including a lateral end wale, a first adjacent wale adjacent said end wale, a second adjacent wale adjacent said first adjacent wale, and a plurality of interior wales; a first elastic yarn laid in said interior wales and in said first and second adjacent wales; a first filler yarn extending in a weft direction in each course and contained within the closed loops of said wales; a second filler yarn extending in a weft direction and contained within the closed loops of the first adjacent wale and within the closed loops of said end wale; and a first locking yarn knitted to form an open loop in alternate courses of said end wale and to form a closed loop in alternate courses of said first adjacent wale.

2. An elastic warp knit fabric according to claim 1 having in addition a first elastic yarn laid in said lateral end wale.

3. An elastic warp knit fabric according to claim 2 wherein said first and second filler yarns extend in the same direction to overlie one another.

4. An elastic warp knit fabric according to claim 2 wherein said first and second filler yarns extend in opposite directions to alternate with one another in the direction of the fabric thickness.

5. An elastic warp knit fabric according to claim 1 having in addition a second elastic yarn laid into said first adjacent wale.

6. An elastic warp knit fabric according to claim 5 having in addition a third filler yarn extending in a weft direction in each course and contained within the closed loops of the interior wales and of the first and second adjacent wales; and a fourth filler yarn extending in a weft direction in each course and contained within the closed loops of the interior wales and of the second adjacent wale.

7. An elastic warp knit fabric according to claim 6 having in addition a second locking yarn knitted for form an open loop in alternate courses of said first adjacent wale and a closed loop in alternate courses of said second adjacent wale.

8. An elastic warp knit fabric according to claim 7 wherein said second filler yarn and said first and second locking yarns are stretch non-stabilized yarns.

9. An elastic warp knit fabric comprising a plurality of base yarns knitted in successive courses to form a plurality of closed loops extending in a warp direction which in turn form a plurality of wales including a lateral end wale, a first adjacent wale adjacent said end wale, a second adjacent wale adjacent said first adjacent wale and a plurality of interior wales; a first elastic yarn laid into said interior wales and in said first and second adjacent wales; a first filler yarn extending in a weft direction in each course and contained within the closed loops of said wales; a second filler yarn extending in a weft direction and contained within the closed loops of the first adjacent wale and within the closed loops of said end wale; a third filler yarn extending in a weft direction in each course and contained within the closed loops of said interior wales and said first and second adjacent wales; a first locking yarn knitted to form an open loop in alternate courses of said end wale and to form a closed loop in alternate courses of said first adjacent wale; and a second locking yarn knitted to form an open loop in alternate courses of said first adjacent wale and to form a closed loop in alternate courses of said second adjacent wale.

10. An elastic warp knit fabric according to claim 9 having in addition a second elastic yarn laid into said first adjacent wale.

11. An elastic warp knit fabric according to claim 10 having in addition a fourth filler yarn extending in a weft direction in each course and contained within the closed loops of said interior wales and said second adjacent wale.

* * * * *